US007152610B2

(12) United States Patent
Csavas

(10) Patent No.: US 7,152,610 B2
(45) Date of Patent: Dec. 26, 2006

(54) HAIR CARE ATTACHMENTS AND DEVICES

(75) Inventor: Emmerich Anthony Csavas, Sydney (AU)

(73) Assignee: Dickson Industrial Co., Ltd., Hong Kong (HK)

( * ) Notice: Subject to any disclaimer, the term of this patent is extended or adjusted under 35 U.S.C. 154(b) by 200 days.

(21) Appl. No.: 10/491,915

(22) PCT Filed: Oct. 8, 2002

(86) PCT No.: PCT/IB02/04133

§ 371 (c)(1),
(2), (4) Date: Apr. 8, 2004

(87) PCT Pub. No.: WO03/030675

PCT Pub. Date: Apr. 17, 2003

(65) Prior Publication Data

US 2004/0261812 A1 Dec. 30, 2004

(30) Foreign Application Priority Data

Oct. 8, 2001 (AU) ..... PR8154

(51) Int. Cl.
*A45D 20/08* (2006.01)

(52) U.S. Cl. ..... 132/271

(58) Field of Classification Search ..... 132/271, 132/269, 272, 143, 118; 34/98, 99, 96, 97, 34/101

See application file for complete search history.

(56) References Cited

U.S. PATENT DOCUMENTS 2,598,330 A * 5/1952 Wilson ..... 132/117
3,065,759 A 11/1962 Frederick
3,835,869 A * 9/1974 Newman et al. ..... 132/271
3,970,093 A * 7/1976 Lardenois ..... 132/271
4,955,145 A * 9/1990 Scivoletto ..... 132/271
5,621,980 A * 4/1997 Kingsbury ..... 34/97
5,729,907 A * 3/1998 Santhouse et al. ..... 34/98
5,983,517 A * 11/1999 Ehlhardt ..... 34/98
6,009,883 A 1/2000 Morrow

FOREIGN PATENT DOCUMENTS

DE 951 164 C 10/1956
GB 490 245 A 8/1938

* cited by examiner

*Primary Examiner*—John J. Wilson
*Assistant Examiner*—Robyn Doan
(74) *Attorney, Agent, or Firm*—Buchanan Ingersoll & Rooney PC

(57) ABSTRACT

A hair care device including a main housing (3) and hair engagement means (2), the main housing (3) includes a hollow compartment interconnecting an upstream end (4) and a downstream end (5), the upstream end (4) includes means for connecting to the outlet nozzle of an air-blowing device (98), the hair engagement means (2) include a plurality of elongated teeth (12) which are thermally conductive and which generally extend along the direction of air blowing from said downstream end (5) when the upstream end (4) of the device is connected to the air-blowing device (98) with the air-blowing device in its normal operating conditions.

16 Claims, 7 Drawing Sheets

HAIR CARE ATTACHMENTS AND DEVICES

FIELD OF INVENTION

This invention relates to hair care devices including hair care attachments and, more particularly, to devices and apparatuses for styling hair. More specifically, although of course not solely limiting thereto, this invention relates to attachments, devices and apparatuses for generally straightening hair.

BACKGROUND OF THE INVENTION

Hair care devices such as hairbrushes, curlers, crimpers and hair blowers are widely used to enhance personal grooming. Conventionally, hair is generally treated or styled with a styling means which is held on one hand while at the same time a hot-air blower is held on the other hand to provide hot air to shape the hair. In many circumstances, for example, in outdoor or temporary environment or during travelling, it is desirable that hair care and styling can be done with a single hand so that the other hand of a user can remain free for, for example, holding a mirror or other accessories or tools.

Among the various known hair care or styling means or tools, means for straightening hair are probably the least developed. Conventionally, hair is straightened by the use of a hairbrush to comb a section of hair away from the hair roots and then by turning the hairbrush to engage and then to pull the hair in order to impart tension to that section of hair straight. Once the hairbrush has moved a sufficient distance away from the roots of the hair and sufficient tension has been imparted to the combed portion, which is the portion of hair caught between the hair roots and the hairbrush, hot air is channelled through the outlet of the hair dryer and then directed back and forth along the tensioned portion of the hair to straighten and keep the straightened hair for a more extended period of time. In this styling method, hot air is used to "lock" the tensioned hair in its straightened form.

Straightening hair in the above conventional manner requires both hands of the user and can be a very tiring and cumbersome process. Also, it will be extremely difficult to straighten hair at the back of a user if the user attempts to straighten hair using the conventional method by himself or herself.

Furthermore, because of the limitation of the conventional brush-and-engage-and-pull-and-blow method of hair straightening, a long strand of hair has to be straightened in several steps which means that sufficient tension has to be maintained along the length of the hair while the engaging positions are moving away from the hair roots. This may be harmful to the scalp as the straightening tension may be significant or even excessive and the duration of the tension may be longer than necessary.

Due to the difficulty and tediousness associated with conventional hair straightening methods, hair straightening is usually performed by professional hairdressers on the clients of hair salons, hairdressers, and the like. Thus, there is at least a need of hair care or styling devices which can be conveniently utilized to perform hair styling, hair-care or hair treatment, especially hair straightening, with a single hand. Also, in view of the limited methods available for straightening hair, there is also a general demand for hair-care or hair-styling devices which can be used to generally straighten hair without requiring the exertion of excessive tension on the hair to alleviate possible damage to the scalp.

Furthermore, it will be desirable if there can be provided hair styling devices, apparatuses or attachments generally for straightening hair in which there is no need to apply tension at discrete intervals along the length of hair in order to impart sufficient tension to straighten hair. Preferably, when using such improved devices, attachments or apparatuses, only mild tension needs to be gradually applied to the hair being straightened while the devices, attachments or apparatuses, progress through the length of the hair in a direction away from the hair roots.

OBJECT OF THE INVENTION

Accordingly, it is an object of the present invention to provide devices, attachments or apparatuses for hair caring or hair styling so that hair caring or hair styling can be performed generally with a single hand. More particularly, it is an object of the present invention to provide attachments, devices or apparatuses generally for straightening hair which can perform the desirable hair styling with a singe hand of the operator. It is a further object of the present invention to provide hair styling or caring attachments, devices or apparatuses which can be conveniently utilized to generally straighten hair by gradually imparting mild tension to the hair when the device is being moved along the length of the hair. Preferably, the hair straightening devices, including attachments, devices and apparatuses, of the present invention can conveniently and effectively straighten hair without the application of excessive tension on the scalp. At a minimum, it is an object of the present invention to provide the public with an alternative choice of devices, attachments, apparatuses and methods for generally straightening hair.

SUMMARY OF THE INVENTION

According to the present invention, there is provided a hair care device including a main housing and hair engagement means, said main housing includes a hollow compartment interconnecting an upstream end and a downstream end, said upstream end includes means for connecting to the outlet nozzle of an air-blowing device, said hair engagement means include a plurality of elongated teeth which are thermally conductive and which generally extend along the direction of air blowing from said downstream end when said upstream end of said device is connected to said air-blowing device with said air-blowing device in its normal operating conditions.

According to a second aspect of the present invention, there is provided a hair care device including an air blower and a hair straightening means, said air blower includes a main housing with a hollow barrel, an air driving means which drives air to move along a barrel and a heating means, said hair straightening means include a hollow compartment with a downstream nozzle and connected to said barrel and hair engagement means disposed adjacent said downstream nozzle, said hair engagement means include a plurality of elongated teeth which are thermally conductive and which generally extend along the direction of air blowing from said downstream end when said air-blowing device with said air-blowing device in its normal operating conditions.

Preferably, the distances between adjacent elongated and thermally conductive teeth are generally adapted so that the hair being trapped in the space between adjacent elongated teeth will be under tension when said device is being moved along said hair and away from the scalp.

Preferably, said downstream end of said device being disposed proximal to said elongated teeth so that the temperature of said elongated teeth is generally dependent on the temperature of air exiting from said downstream end.

Preferably, said downstream end and said hair engaging means of said device are disposed so that, during normal use, said hair engagement means are generally disposed intermediate of the scalp of the person whose hair is being cared and the air exiting from said downstream end of said device.

Preferably, said downstream end of said device includes an elongated aperture which generally extends along a direction which is generally transversal to the direction of air movement exiting from said aperture.

Preferably, said main housing is generally tubular and said elongated teeth generally extend along the axial direction of said tubular main housing.

Preferably, said elongated teeth are generally distributed along a direction which is generally transverse to the direction of air blowing from said device when said device is connected to said air blowing device with said air blowing device in its normal operating conditions.

Preferably, said hair engagement means includes a comb with at least a row of thermally conductive and elongated teeth distributed along a direction which is generally transversal to the direction of air leaving said device when said device is connected to said air blowing device with said air blowing device in its normal operating conditions.

Preferably, said main housing includes thermally insulating guarding means bracketing said elongated teeth.

Preferably, said main housing includes a bifurcated and thermally insulated guarding means extending generally along the direction of extension of said elongated teeth and bracketing said elongated thermally conductive teeth between said bifurcated means.

Preferably, the length of said elongated teeth is generally shorter than that of the main housing.

Preferably, said main housing is generally made of a thermally insulating material.

Preferably, an exhaust means is disposed on said main housing and intermediate between said downstream end and upstream end.

Preferably, said exhaust means includes an aperture disposed on the same side of said downstream end in relation to said elongated teeth.

According to yet another aspect of the present invention, there is provided a method of hair straightening, said method comprising the steps of:

heating metal teeth of a comb by blowing hot air over said comb, inserting said comb into a bundle of said hair until hair is engaged by the comb, moving said comb along said hair whilst blowing hot air onto said comb and through said hair.

whereby said hair is simultaneously tensioned and dried.

BRIEF DESCRIPTION OF THE DRAWINGS

Preferred embodiments of the present invention will be explained in further detail below by way of examples and with reference to the accompanying drawings in which.

DETAILED DESCRIPTION OF THE PREFERRED EMBODIMENTS

Figure 1:
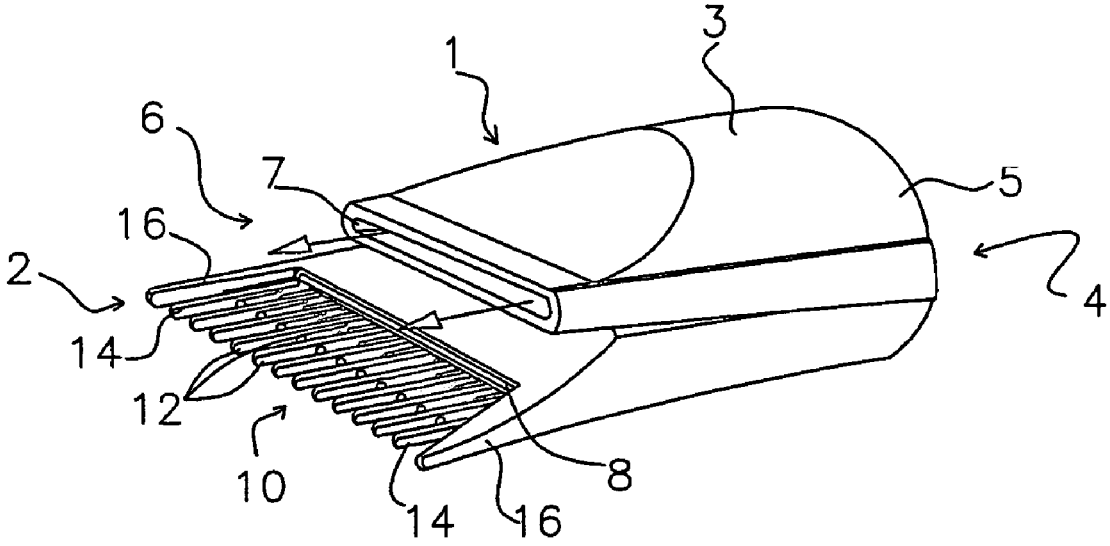
FIG. 1 is a perspective view of a first preferred embodiment of the present invention in the form of an attachment for connection to a hair care apparatus such as a blow dryer.
Figure 2:
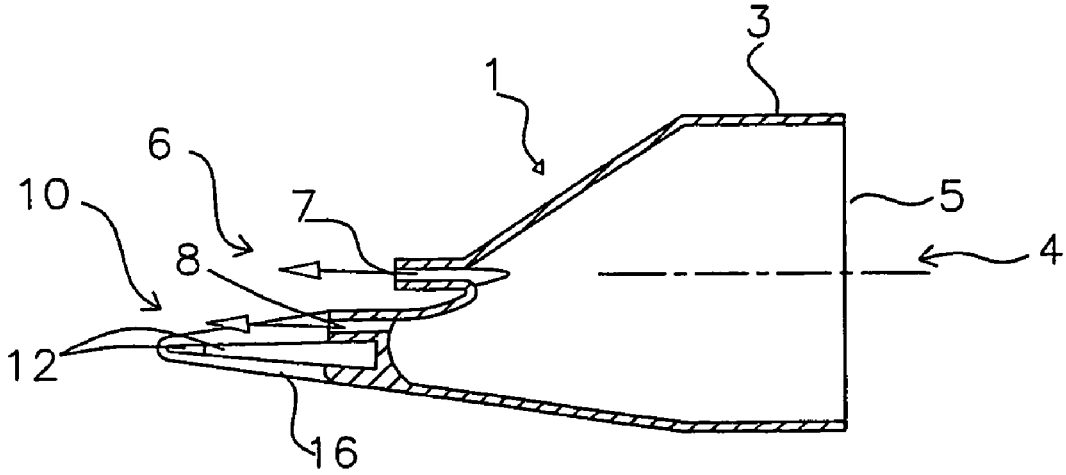
FIG. 2 is a cross-sectional view of the attachment of FIG. 1 showing in more detail the elongated teeth, the teeth guards and the direction of exit of air from the downstream end of the attachment in relation to the main housing of the attachment.

Referring firstly to FIGS. 1 and 2, there is shown a hair care device in the form of an attachment 1 for coupling to the nozzle of a hair dryer or hair blower. The device 1 includes a main housing 3 and hair engagement means 2. The main housing 3 includes a hollow body with an upstream end 4 and a downstream end 5. The downstream end includes a primary downstream aperture 8 which is generally disposed so that the air leaving the device 1, after accelerating along the barrel of the hair dryer, will generally move along the direction of extension of the elongated teeth 12 of the hair engagement means 2. The primary downstream aperture 8 is further disposed so that it is proximal enough to affect the temperature of the elongated teeth so that their temperature is generally dependent or correlative to the temperature of the air exiting from the device 1.

A secondary downstream aperture 7 is disposed adjacent to the primary aperture 8 and further displaced from the row of the elongated teeth 12. This secondary aperture 7 provides hot- or warm-air to the portion of hair adjacent to the section of hair being straightened and can help to expedite the drying of wet hair. Of course, the device can be provided without a secondary aperture or the secondary aperture 7 can be selectively blocked where no additional hot air for hair drying is needed. To provide the selective blocking of the secondary aperture 7, a controllable valve which can control the volume rate of exit of hot hair from the device may be included.

The hair engagement means 2 includes a plurality of elongated teeth 12 which generally extend along an axial direction which is generally parallel to the direction of exit of air from the device when the device 1 is attached to a hot-air blower in its ordinary operating conditions. The elongated teeth 12 are generally thermally conductive so that its temperature will be relatively sensitive to and dependent on the temperature of the air exiting from the device 1. The thermally conductive and elongated teeth 12 are preferably spaced so that when the elongated teeth members 12 are inserted into the hair of a user, there will be a noticeable degree of tension or friction dragging the device when the hair device 1 is being moved along the hair. This imparted tension or friction when coupled with the elevated temperature of the elongated teeth 12 resulting from the heating of the thermally conductive teeth by hot air exiting from the air blower have shown to provide a very satisfactory hair straightening effect without the need of applying excessive tension to the hair.

In order to ensure that a reasonable level of thermal energy can be imparted to the elongated teeth 12 for hair straightening, the teeth 12 are generally thermally conductive and may be made from or coated with a suitable thermally conductive material, such as stainless steel, copper, aluminium or a suitable alloy. The elongated teeth 12 in the present preferred embodiment are generally arranged in the form of a comb 10 with at least a row of parallelly disposed teeth. The elongated teeth are generally distributed in a row which extends along a direction generally transversal to the direction of exit of the hot air leaving the primary downstream aperture or nozzle 8 when the device 1 is attached to a hair dryer under normal operating conditions.

To further facilitate the movement of the attachment 1 through wet hair, every second tooth of the comb member 10 is of a longer length so that there is a wider space between the adjacent upper portions of the longer teeth and more hair can be accommodated. To protect the outermost teeth 14 from damage and misalignment as well as acting as an additional barrier to ensure that the heated outermost teeth 14 do not accidentally graze the ear, scalp or skin of a person whose hair is being straightened, a pair of bifurcated guarding means 16 is provided adjacent to the outermost teeth 14 and separating the outermost teeth 14 from the outside. In other words, the bifurcated pair of the guarding means 16 bracket between them the elongated teeth 12.

To provide for effective and more even thermal transfer from the hot air to the row of elongated teeth member 12, the primary aperture 8 is preferably elongated and extend along a direction which is generally parallel to the length of the comb member 10, that is, along the direction of distribution of the elongated teeth 12. It has been noted that a device having a comb member with elongated teeth 12 which are more closely spaced apart is more preferably for straightening finer hair and a device having a comb member 10 with less closely spaced apart teeth 12 is more preferred for curling thicker and/or curlier hair. This is probably because, for finer hair, a more closely spaced apart teeth arrangement will limit the number of hair to be trapped between adjacent teeth and the heat transfer can be optimised.

On the other hand, the space between adjacent teeth can be increased for a device for treating thicker or curlier hair because fewer hair strands can be retained within the same teeth slot if the hair is thicker. Thus, to provide an optimal hair straightening effect without requiring excessive tension, the spacing between adjacent teeth on the device 1 should be one which will impart a reasonable level of friction or tension while an adequate amount of heat can be transferred to the trapped hair. In general when a reasonable level of tension is applied, the scalp will not be painful while the device is ploughing through the hair. To be reasonably effective, a reasonable number of hair strands should be kept between adjacent teeth so that the straightening process can be easily accomplished. Thus, in utilizing the present device, it is preferable that a user will select a device with a suitable teeth length and spacing to ensure optimal straightening results.

Furthermore, as the device 1 is generally used to style hair in a manner similar to combing while the straightening, it is preferred that the length of the elongated teeth 12 is generally similar to the length of teeth in a conventional comb which is generally shorter than the length of a finger of a typical adult. Further embodiments of the present invention to be described below are provided for the straightening of different hair types. In general, the same numerals will be used for clarity for referring to the same common parts where appropriate unless the context otherwise requires.

Figure 3:
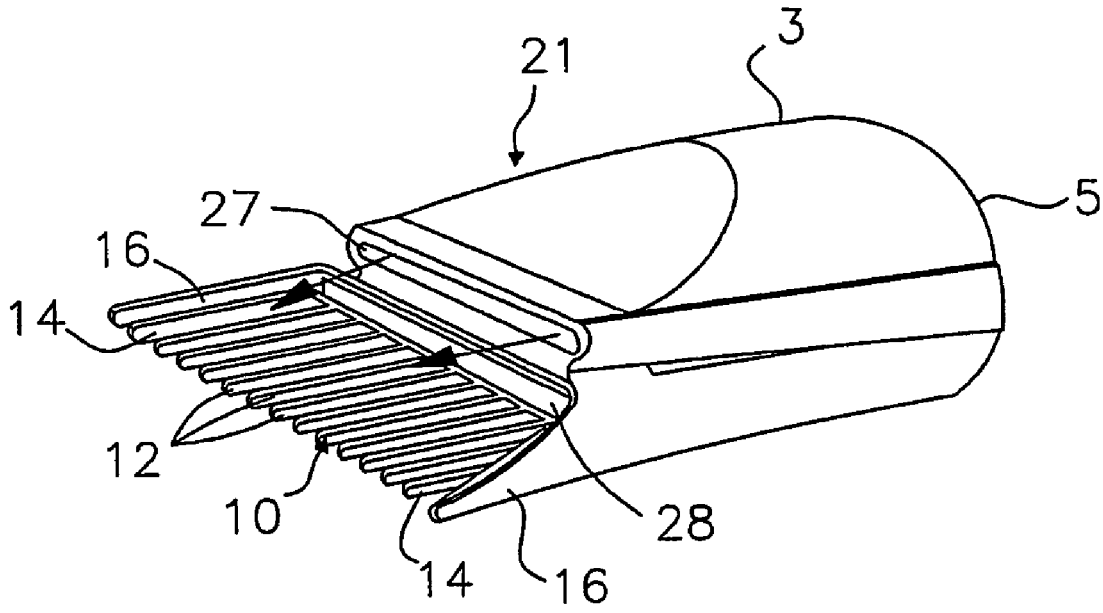
FIG. 3 is a perspective view of a second preferred embodiment of the present invention in another form of an attachment.
Figure 4:
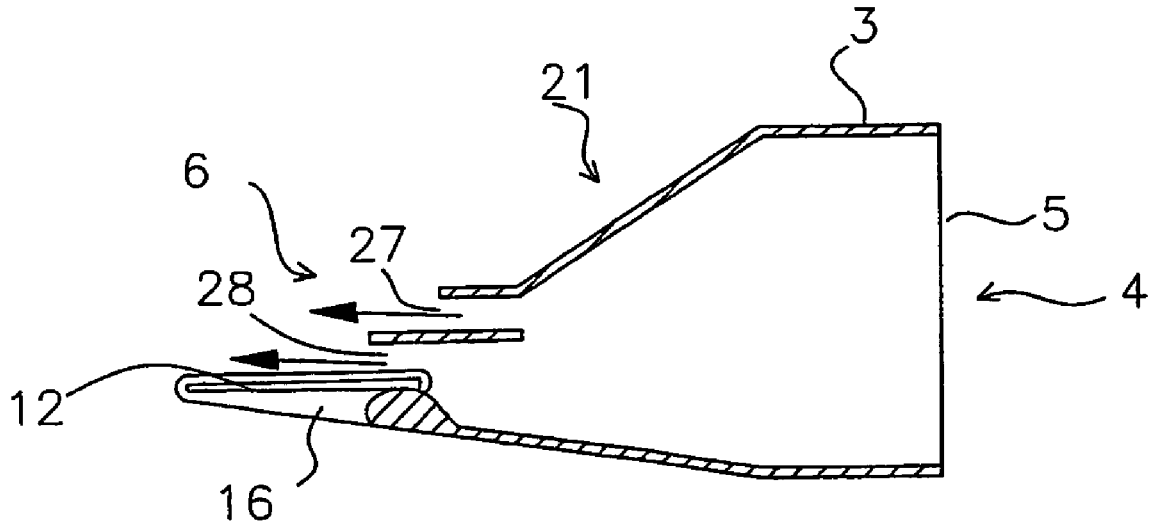
FIG. 4 is a cross-sectional view of the attachment of FIG. 3 showing in more detail the elongated teeth, the teeth guards and the direction of exit of air from the downstream end of the attachment in relation to the main housing of the attachment.

FIGS. 3 and 4 illustrate a second preferred embodiment of an attachment 21 of the present invention which is similar to that of FIG. 1 but with a larger primary downstream aperture 28 and elongated teeth 12 that are fewer in number and all of approximately the same size as the larger teeth 12 of the first embodiment. The spacing between the elongated teeth 12 is greater than those of the first embodiment, making this attachment 21 more suitable for straightening relatively thicker or curlier hair. It will be noted that the length of the elongated teeth is generally shorter than the length of the tubular housing.

Figure 5:
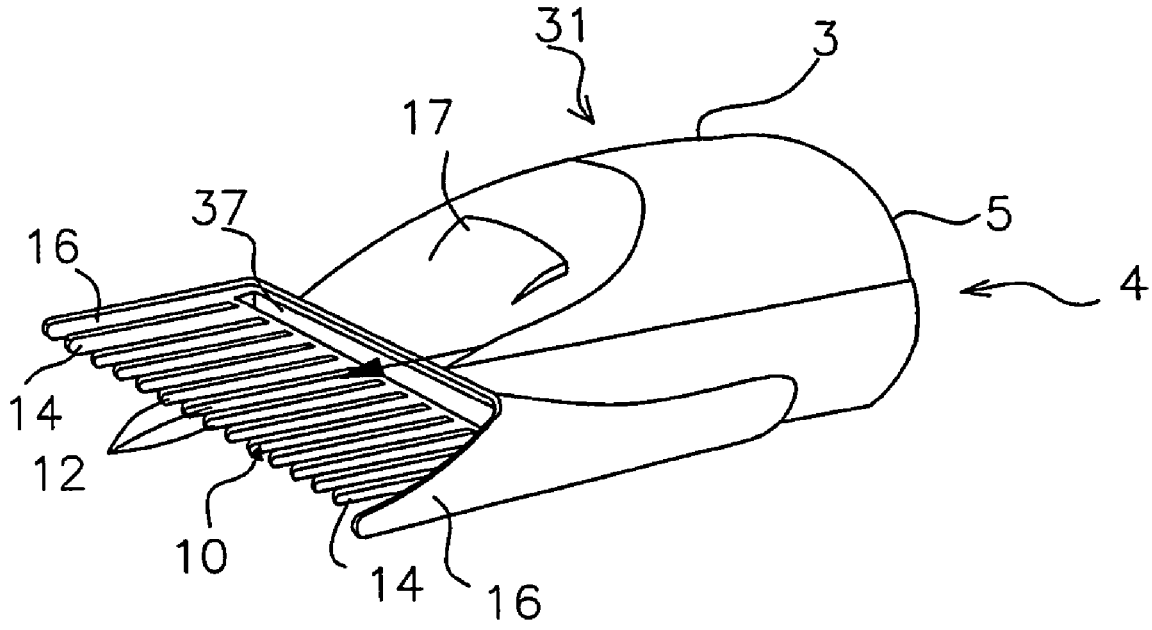
FIG. 5 is a perspective view of a third preferred embodiment of the present invention in a further form of an attachment.
Figure 6:
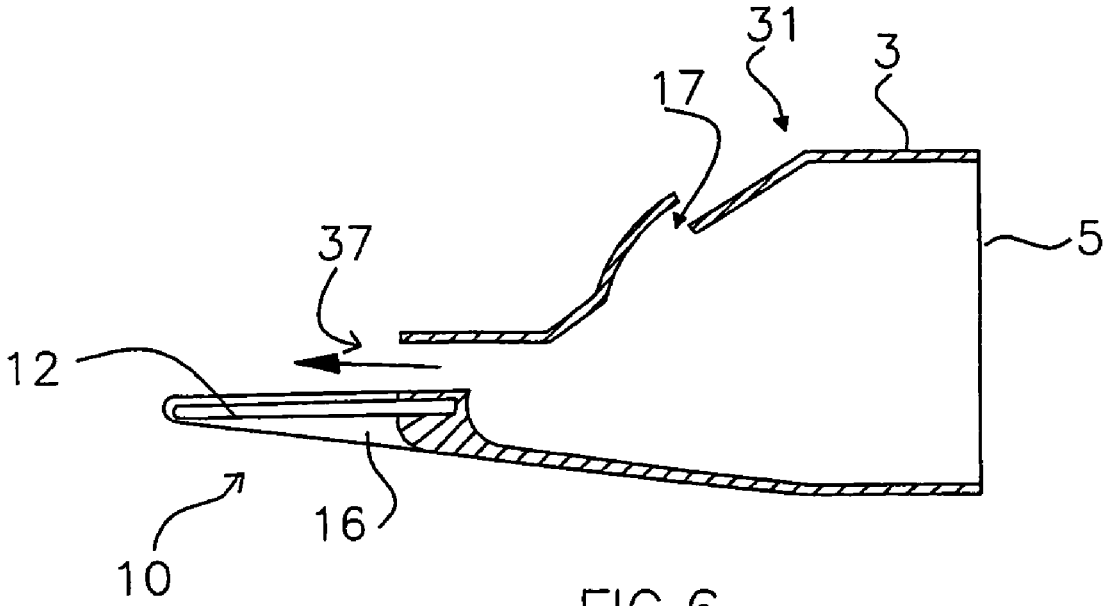
FIG. 6 is a cross-sectional view of the attachment of FIG. 5 showing in more detail the elongated teeth, the teeth guards and the direction of exit of air from the downstream end of the attachment in relation to the main housing of the attachment.

A third embodiment 31 of this invention is shown in FIGS. 5 and 6 which is again similar to the attachments 1 and 21 of previous embodiments but having a single, larger aperture or nozzle 37 and fewer outwardly projecting teeth 12 than both the previous embodiments. The teeth 12 of the attachment 31 are larger in size than those of attachments, 1 and 21 and are most suited to the thickest and curliest hair that can be straightened using a blow dryer attachment without resorting to the application of more powerful (and expensive) chemical relaxing agents to straighten the hair. An exhaust aperture 17 is provided on the main housing to allow escape of hot air when the nozzle 37 is blocked or tampered.

Figure 7:
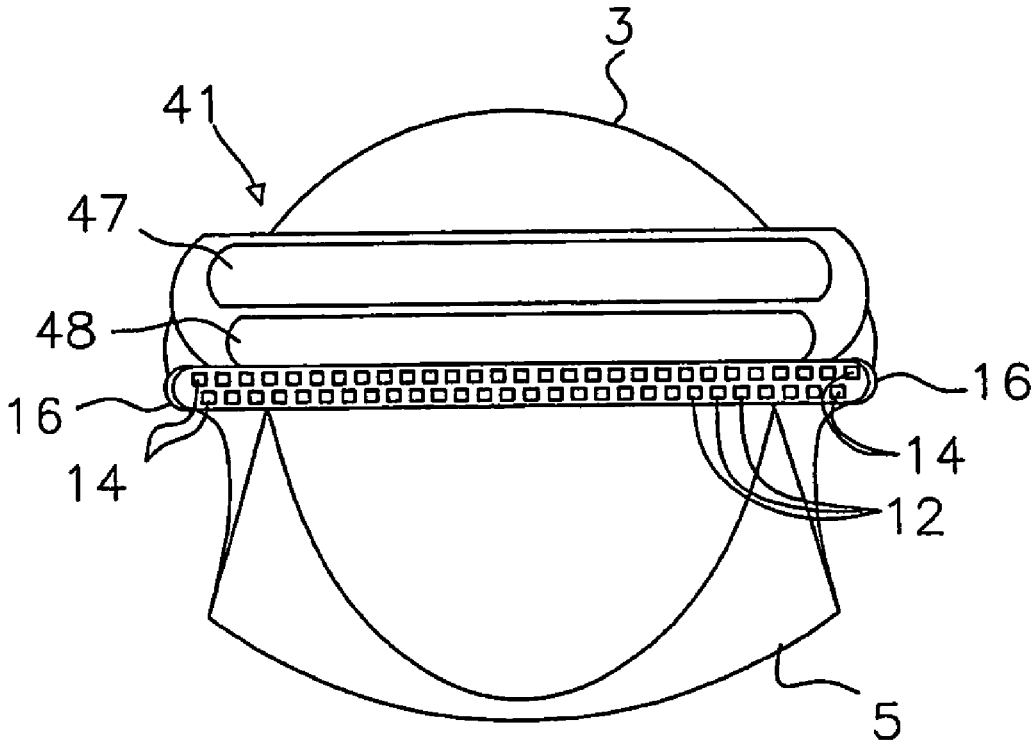
FIG. 7 is a front and elevation view of a fourth preferred embodiment of the present invention in yet another form of an attachment.
Figure 8:
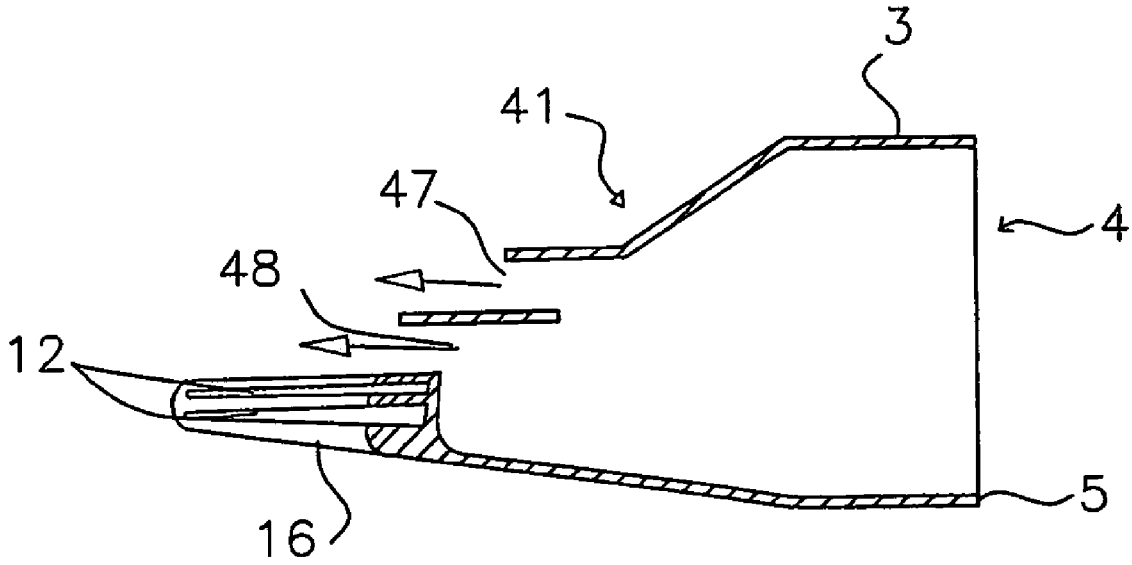
FIG. 8 is a cross-sectional view showing in more detail the embodiment of FIG. 7.

FIGS. 7 and 8 illustrate a fourth embodiment of an attachment 41 of the present invention having primary and secondary downstream nozzles 47, 48 and which differs from previous embodiments in that there are provided two rows of elongated teeth 12. The elongated teeth 12 are inter-digitated or offset relative to the other to maximize the number of strands of hair that come into contact with the heated teeth 12. Preferably, the teeth 12 are more closely spaced apart than the previous embodiments. The guards 16 again ensure that the ears, scalp and skin of the person whose hair is being straightened is protected from the heated outermost teeth 14.

Figure 9:
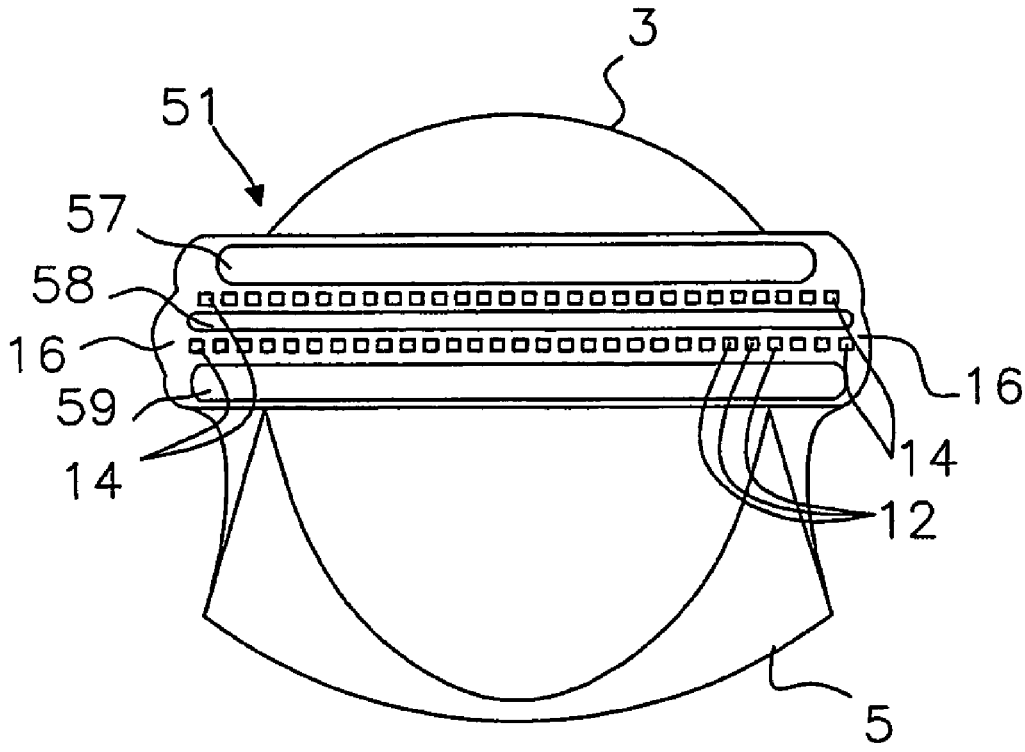
FIG. 9 is a front and elevation view of a fifth preferred embodiment of the present invention in yet a further form of an attachment.
Figure 10:
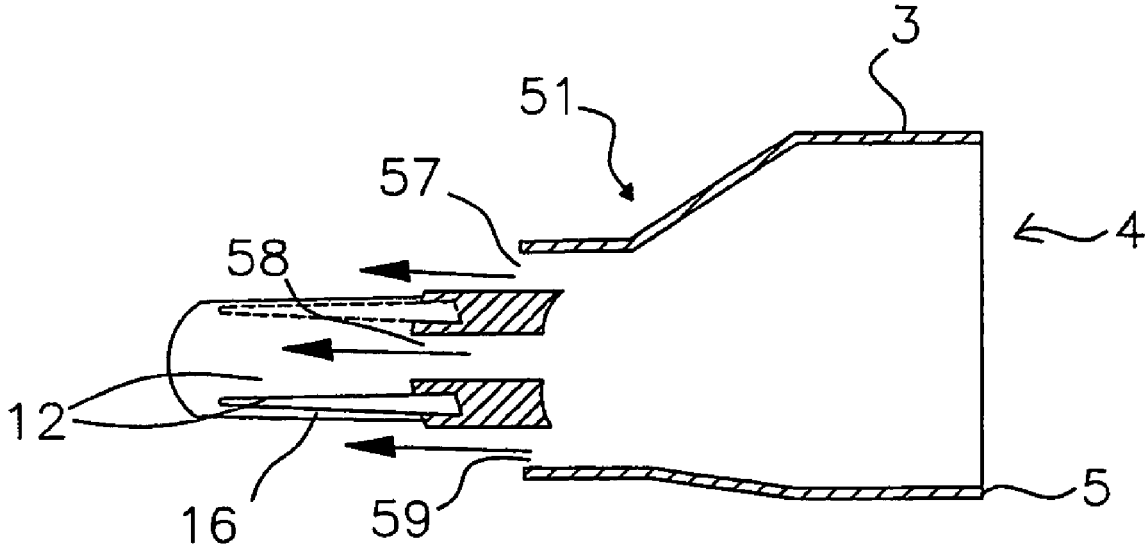
FIG. 10 is a cross-sectional view showing in more detail the embodiment of FIG. 9.

The fifth embodiment of an attachment 51 of the present invention which is suitable for a blow dryer is illustrated in FIGS. 9 and 10 and is similar to that of the fourth embodiment but has primary, secondary and tertiary nozzles 57, 58, 59 with two rows of elongated teeth 12 that are laterally and offset relative to each other and positioned to either side of the secondary downstream aperture 58. As seen from FIG. 10, this arrangement allows a greater volume of hot air to pass by both the upper and under surfaces of the two rows of the offset teeth 12.

Figure 11:
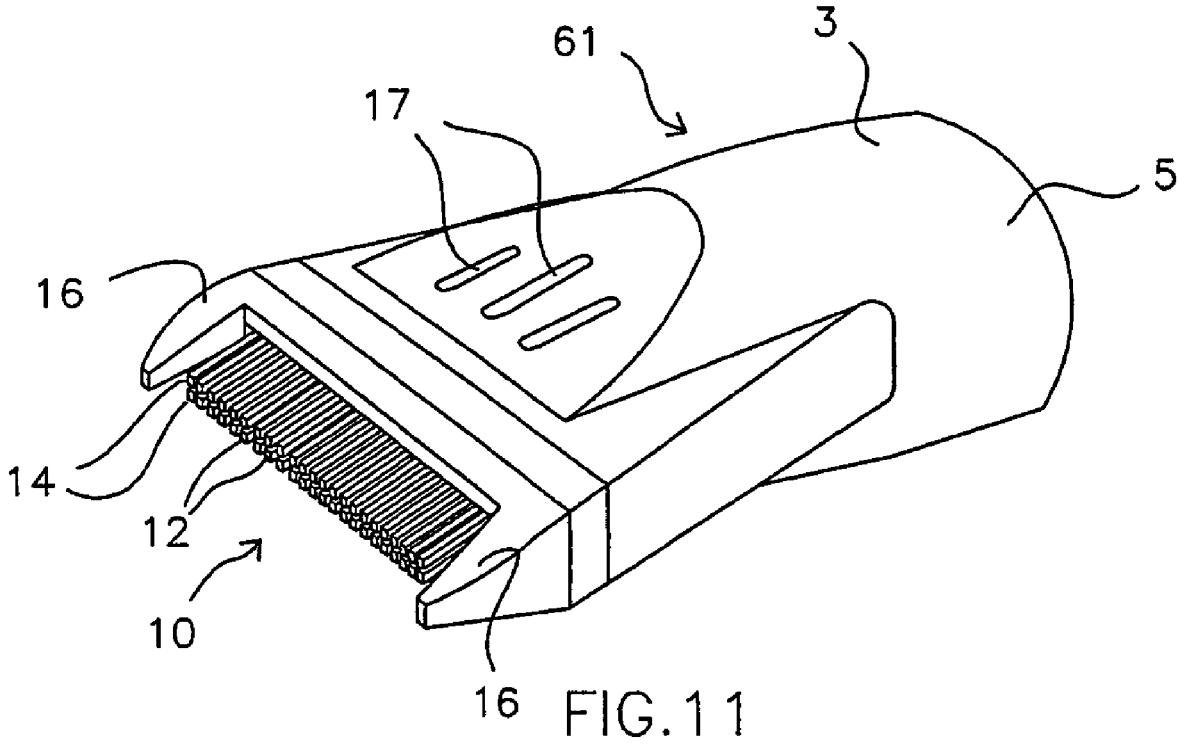
FIGS. 11 is a perspective view of a sixth preferred embodiment of the present invention in a further form of an attachment.
Figure 12:
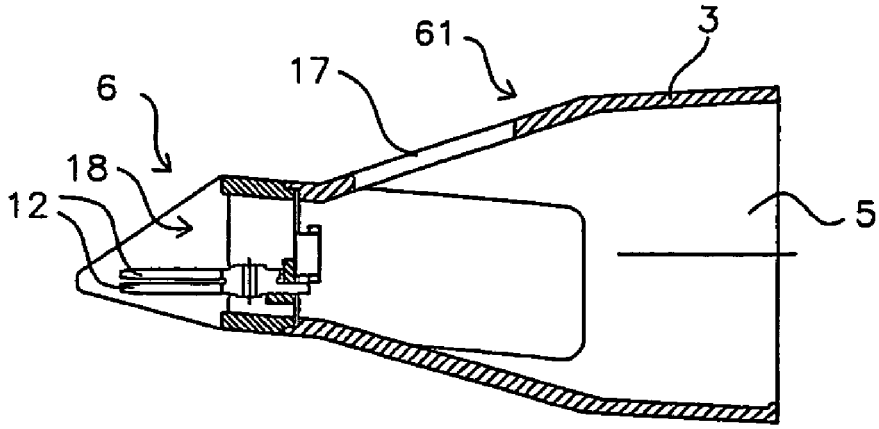
FIG. 12 is a cross-sectional view showing in more detail the embodiment of FIG. 11.

A further embodiment of an attachment 61 of the present invention is shown in FIGS. 11 and 12. In this embodiment, two rows of elongated teeth 12 are directly disposed at the exit of the downstream aperture and a plurality of exhaust slots 17 are provided for escape of hot air when the downstream end is blocked to alleviate the risk of personal injury.

Figure 13:
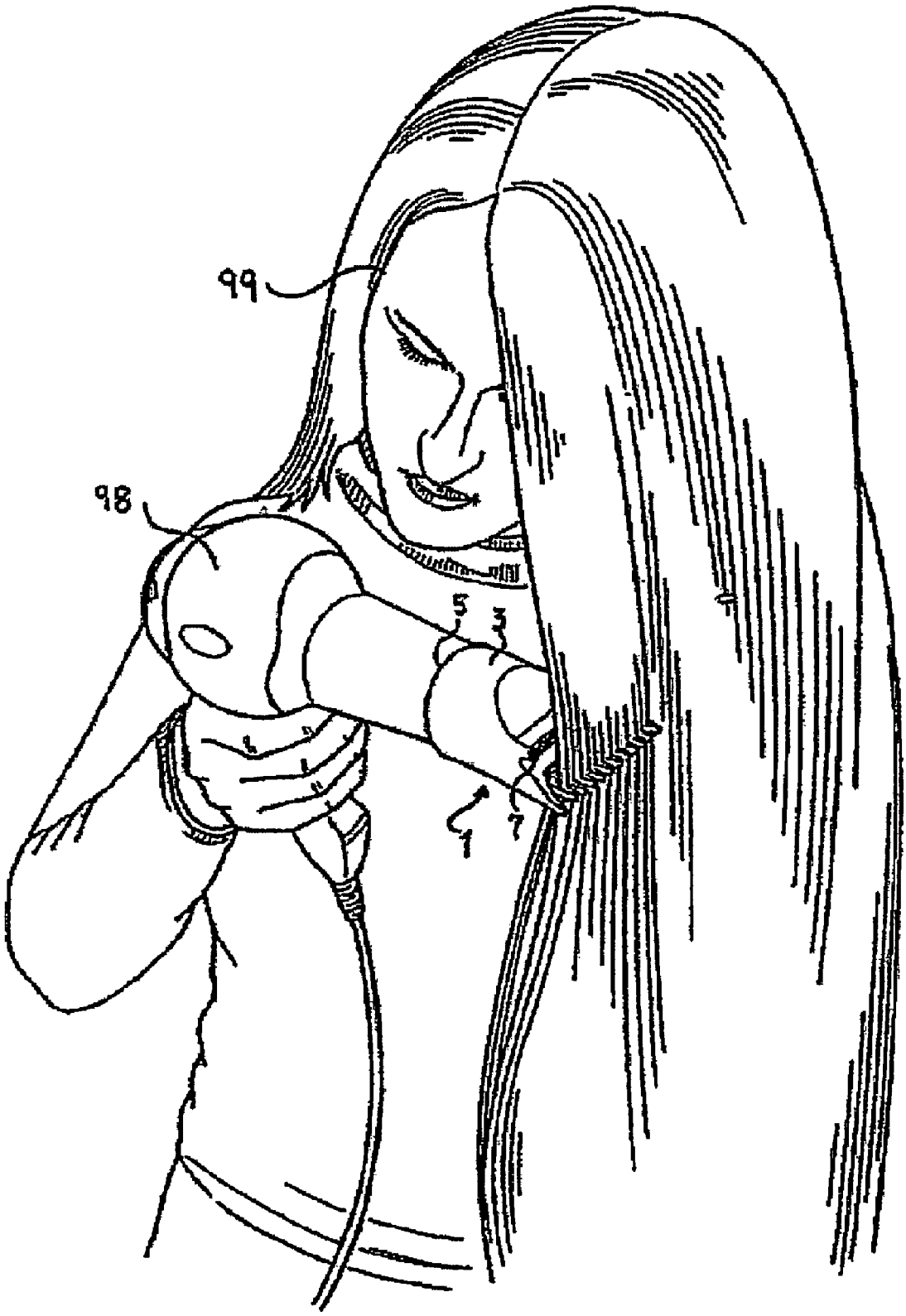
FIG. 13 is a perspective view of a seventh embodiment of the present invention showing a hair dryer incorporating the hair straightening means of the present invention.

A yet another embodiment of an apparatus of the present invention including a hair blower 98 on the hair care means 1 of any of the previous embodiments is shown in FIG. 13. The hair care device can be integrally formed with the barrel of the hair blower and can be, more preferably, detachably attached to the nozzle of the hair blower.

A method of straightening hair with this apparatus is also shown in FIG. 13. Referring to the Figure, it is shown that a user 99 can straighten the user's own wet hair without the assistance of a hairdresser. As seen in FIG. 13 the user 99 directs or inserts the comb 10 into the hair to thereby define a bundle of strands of hair. These strands are gripped to some extent by the teeth while the comb member is moved through the hair from the roots towards the tips of the strands. In this way, the hair is simultaneously tensioned whilst being heated or warmed both by contact with the hot conductive or metal teeth 12 end by the blowing of hot air over the teeth 12 and through the strands of hair. It will be noted that in prior art methods, the hot air only strikes one surface of the bundle of strands and will be generally deflected by the bundle of hair, rather than passing through it.

Of course, the other afore-described embodiments can also be used in this embodiment without loss of generality and when they are so used, one or more exhaust slots 17 can be provided. In the event that the outlet nozzles 7, 8 are directed against the scalp of the used 99 , the hot air can escape via one or more of the exhaust slot(s) 17. This prevents hot air pooling or building up adjacent the scalp which may otherwise induce the user 99 to operate the hair dryer 98 at a lower temperature setting.

Professional hairdressers are also able to use the device of the present invention and will appreciate that the attachment 1 does away with the need for using a hairbrush to create the initial tension in the hair before the blow dryer 98 is used to retain the hair in its straightened form.

While the present invention has been explained by reference to the preferred embodiments described above, it will be appreciated that the embodiments are only examples provided to illustrate the present invention and are not meant to be restrictive on the scope of the present invention. The scope of this invention should be determined from the general principles and spirit of the invention as described above. In particular, variations or modifications which are obvious or trivial to persons skilled in the art, as well as improvements made on the basis of the present invention, should be considered as falling within the scope and boundary of the present invention. Furthermore, while the present invention has been explained by reference to devices or apparatuses for straightening hair, it should be appreciated that the invention can apply, whether with or without modification, to other hair styling purposes.

The invention claimed is:

1. A hair care device comprising a main housing and hair engagement means, said main housing comprising an upstream end and a downstream end interconnected by a hollow compartment, an attachment means at said upstream end for coupling said hair care device to an outlet nozzle of an hot air blowing device, and an air-exit aperture at said downstream end; and said hair engagement means comprising a plurality of thermally conductive and elongate comb-like teeth protruding from said downstream end; wherein said air-exit aperture and said hair engagement means are arranged such that, when said device is coupled with a hot-air blowing device, hot air emerging from said air-exit aperture is directed towards said plurality of thermally conductive teeth for direct heating thereof, and such that heat and tension can be imparted simultaneously on tresses of hair in engagement with said plurality of thermally conductive teeth for hair straightening during normal use.

2. A hair care device of claim 1, wherein separation between adjacent elongated and thermally conductive teeth is adapted so that hair engaged by said plurality of thermally conductive and elongated teeth will be drawn under heat and tension when said hair care device is being moved along said hair and away from the scalp during normal use.

3. A hair care device of claim 1, wherein said downstream end of said hair care device is proximal to said plurality of thermally conductive and elongated teeth so that the temperature of said elongated teeth is dependent on the temperature of hot air exiting from said downstream end.

4. A hair care device of claim 1, wherein said plurality of thermally conductive teeth are arranged into a row which extends along a direction which is generally transversal to the direction of air leaving said device when said device is connected to said hot air blowing device in its normal operating conditions.

5. A hair care device of claim 4, wherein said main housing includes thermally insulating guarding means bracketing said elongated teeth.

6. A hair care device of claim 1, wherein said main housing includes a bifurcated and thermally insulated guarding means extending generally along the direction of extension of said elongated teeth and bracketing said plurality of thermally conductive teeth between said bifurcated means.

7. A hair care device according to claim 1, wherein a second air-exit aperture is disposed on said main housing and intermediate between said downstream end and upstream end.

8. A hair care device including a hot air blower and a hair care device according to claim 1.

9. A hair care device according to claim 1, wherein said plurality of elongated teeth extend along an axial direction, are arranged in a longitudinal row and comprise teeth of a shorter length and teeth of a longer length, the teeth of a longer length and the teeth of a shorter length being alternately disposed wherein the free ends of said shorter teeth are aligned and retreated from the free ends of said longer teeth.

10. A hair care device according to claim 1, wherein said air-exit aperture is elongate and substantially parallel to a row of said plurality of elongated teeth.

11. A hair care device according to claim 9, wherein said main housing further comprises a second air-exit aperture, said second air-exit aperture being elongate and substantially parallel to said row of teeth, said second air-exit aperture being disposed for blowing hot air towards hair to be styled during normal use, said first air-exit aperture being intermediate said second air-exit aperture and said plurality of teeth.

12. A hair care device according to claim 1, wherein said plurality of elongated teeth are arranged into a longitudinal row with said teeth extending along an axial direction, and wherein said main housing further comprises a pair of insulating guard means, said pair of guard means forming a pair of insulating brackets so that said row of elongated teeth is contained within said pair of insulating brackets along the longitudinal direction of said row.

13. A hair care device according to claim 1, wherein said plurality of teeth are distributed on a first row and a second row which are parallel, elongate teeth in said second row being offset from teeth of said first row and are present in the space between adjacent teeth of said first row.

14. A hair care device according to claim 1, wherein said plurality of teeth are distributed on a first row and a second row which are parallel, an elongate air-exit aperture substantially parallel to said first and second rows being disposed intermediate said first and second rows of teeth.

15. A hair care device according to claim 1, wherein said teeth are of aluminum, stainless steel, copper or thermally conductive alloys.

16. A method of hair straightening using a hair care device of claim 1, said method comprising the steps of:

heating up said plurality of thermally conductive teeth of said hair care device by hot air exiting from said hair care device, inserting said plurality of thermally conductive teeth of said hair care device heated by hot air exiting from said hair care device into a bundle of hair until hair is engaged by said plurality of thermally conductive teeth of said hair care device heated by hot air exiting from said hair care device, moving said hair care device along said hair whilst blowing hot air onto said plurality of thermally conductive teeth of said hair care device by hot air exiting from said hair care device and through said hair, whereby said hair is simultaneously tensioned and dried.

* * * * *